US006635345B2

(12) United States Patent
Ilg et al.

(10) Patent No.: US 6,635,345 B2
(45) Date of Patent: Oct. 21, 2003

(54) MORPHOLOGICALLY STABLE BULKED CONTINUOUS FILAMENTS AND METHODS AND SYSTEMS FOR MAKING THE SAME

(75) Inventors: Otto M. Ilg, Asheville, NC (US); Randall A. Sferrazza, Farmington, MI (US)

(73) Assignee: Honeywell International Inc., Colonial Heights, VA (US)

( * ) Notice: Subject to any disclaimer, the term of this patent is extended or adjusted under 35 U.S.C. 154(b) by 0 days.

(21) Appl. No.: 10/121,919

(22) Filed: Apr. 15, 2002

(65) Prior Publication Data

US 2003/0075823 A1 Apr. 24, 2003

Related U.S. Application Data

(63) Continuation of application No. 09/981,432, filed on Oct. 18, 2001.

(51) Int. Cl.[7] ..... D01F 6/00

(52) U.S. Cl. ..... 428/364; 428/395

(58) Field of Search ..... 428/364, 395; 57/245; 264/103

(56) References Cited

U.S. PATENT DOCUMENTS 3,771,307 A * 11/1973 Petrille ..... 57/157 TS
4,246,747 A * 1/1981 Plunkett et al. ..... 57/245
6,447,703 B1 * 9/2002 Waddington et al. ..... 264/103

* cited by examiner

*Primary Examiner*—N. Edwards
(74) *Attorney, Agent, or Firm*—Nixon & Vanderhye PC

(57) ABSTRACT

Morphologically stable BCF yarns, and the methods and systems for making such BCF yarns are provided. More specifically, the BCF yarn is melt-spun, drawn and textured. The yarn texturizing includes a relatively low efficiency fluid jet texturizer, that is a fluid jet texturizer operating at a sufficiently low fluid jet velocity and a sufficiently high fluid jet temperature to obtain a yarn skein shrinkage of less than about 0.50 inch, more preferably about 0.25 inch or less. Most preferably, the BCF yarns are formed of nylon-6 and exhibit an alpha-crystalline content of less than about 45%, and usually between about 45% to about 55%.

12 Claims, 1 Drawing Sheet

Figure 1:
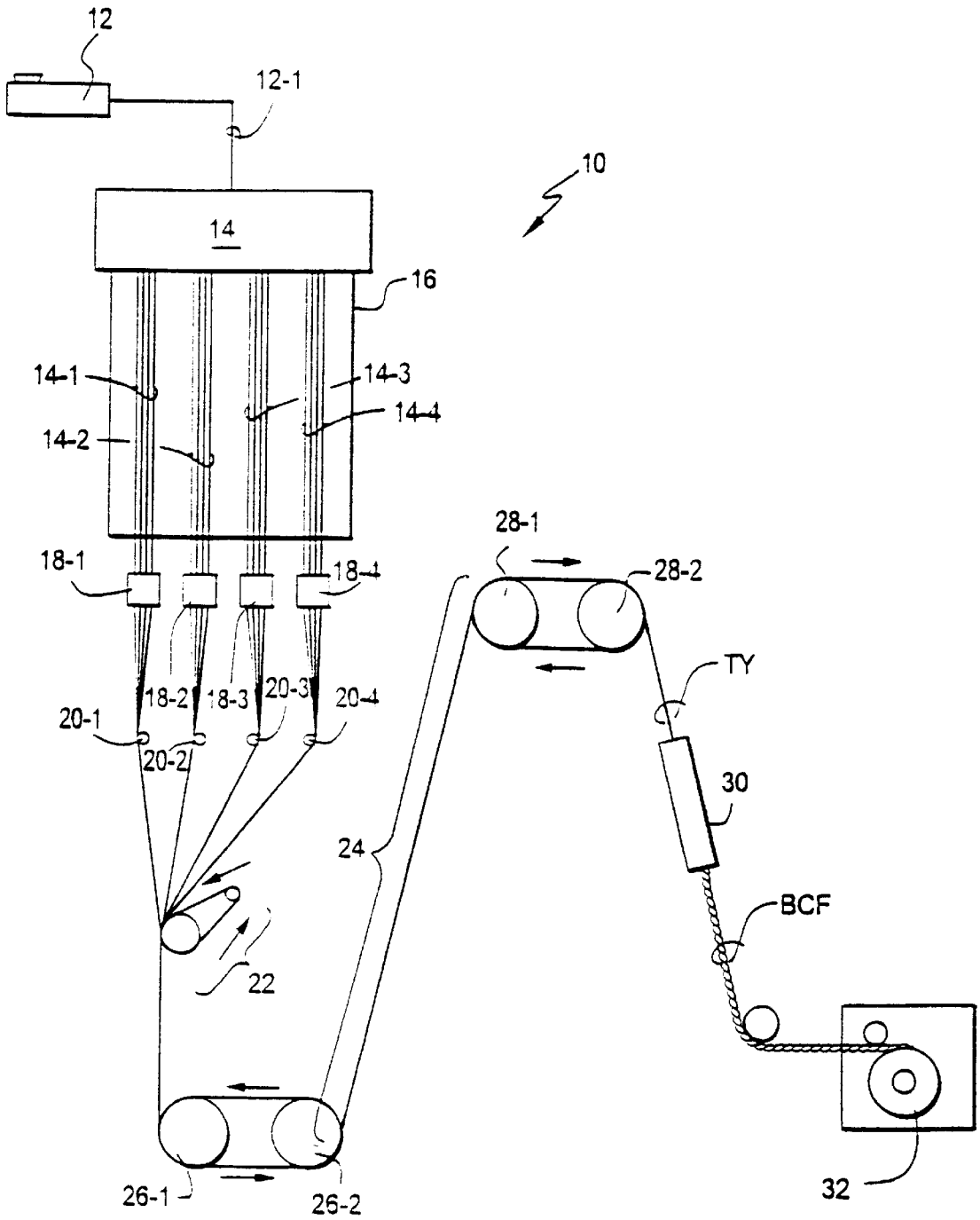

MORPHOLOGICALLY STABLE BULKED CONTINUOUS FILAMENTS AND METHODS AND SYSTEMS FOR MAKING THE SAME

This application is a division of application Ser. No. 09/981,432, filed Oct. 18, 2001, now pending, the entire content of which is hereby incorporated by reference in this application.

FIELD OF THE INVENTION

The present invention relates generally to synthetic filaments and to their processes and systems for manufacture. More specifically, the present invention relates to processes and systems for making melt-spun, synthetic polymeric yarns of bulked continuous filaments (BCF), especially carpet yarns comprised of nylon BCF.

BACKGROUND AND SUMMARY OF THE INVENTION

I. Definitions

As used herein, certain terms have the following meanings:

"Filament" or "filaments" mean fibrous strands of extreme or indefinite length. In contrast, "staple fibers" mean fibrous strands of definite and short lengths.

"Yarn" means a collection of numerous filaments which may or may not be entangled, twisted or laid together.

"One-step" means a process for making yarn whereby no intermediate winding of the yarn occurs between the spinning, drawing and texturing processes.

"Texturing" means any operation on filaments which results in crimping, looping or otherwise modifying such filaments to increase cover, resilience, bulk or to provide a different surface texture or hand. A "bulked continuous filament" is therefore a "filament" which has been subjected to one or more "texturing" operation(s).

"Morphologically stable" means a bulked continuous filament such that yarns of such filaments exhibit a skein shrinkage of less than 0.50 inch, and more preferably about 0.25 inch or less.

II. Background of the Invention

One-step processes for manufacturing melt-spun polymeric yarns of bulked continuous filaments (BCF) are known as evidenced by the following U.S. Pat. Nos. 5,804,115; 5,487,860; 4,096,226; 4,522,774; and 3,781,949 (the entire content of each cited U.S. Patent being incorporated expressly hereinto by reference). In general, such processes involve the continuous sequential operations (i.e., without any intermediate winding of the yarn) of spinning, drawing and texturing. The resulting BCF yarn is thereafter wound on a package either sold as is or subjected to further processing (e.g., coloration, entangling with other yarns, fabric formation, and the like).

Conventional one-step BCF yarn production techniques typically involve the melt-spinning of multiple polymeric filament streams which, when cooled form the precursor (or undrawn) filaments of the later BCF yarn. These undrawn filaments are then typically immediately directed to separated pairs of godet rolls (sometimes referred to as "duos" in art parlance) operating at different rotational speeds. The BCF yarn will therefore be drawn between such duos at a desired draw ratio dependent on the duo speed differential, yarn temperature, yarn speed and the like. The duos are typically heated to the same temperature in order to elevate the filament temperature prior to texturing.

The thus drawn and heated yarn is then subjected to a texturing operation, usually accomplished by feeding the drawn continuous filament yarn into a fluid jet texturing unit at a rate faster than the rate at which the textured yarn is drawn off and subjecting the yarn in the unit to a turbulent region of a fluid jet, usually at elevated temperature (e.g., a so-called fluid jet texturing method). The resulting textured continuous filament yarn exhibits increased bulk as compared to the non-textured yarn being fed into the texturing unit to achieve the BCF yarn which may then be wound up to form a yarn package.

Recently, in copending and commonly owned U.S. patent application Ser. No. 09/599,458 filed on Jun. 22, 2000 (the entire content of which is expressly incorporated hereinto by reference), there are disclosed methods and systems for making melt-spun, drawn and textured BCF yarns, wherein prior to texturing the yarn is subjected to differential temperature condition. Most preferably, such differential temperature condition is accomplished using the duo rolls employed in drawing the BCF, such that one of the rolls is maintained at a greater temperature as compared to the other of the rolls. The morphology of the BCF yarn can thus be variably controlled.

III. Summary of the Invention

Broadly, the present invention is embodied in morphologically stable BCF yarns, and the methods and systems for making such BCF yarns. More specifically, according to the present invention, the BCF yarn is melt-spun, drawn and textured, wherein the yarn texturizing includes operating a fluid jet texturizer at a sufficiently low fluid jet velocity and a sufficiently high fluid jet temperature to obtain a yarn skein shrinkage of less than about 0.50 inch, more preferably less than about 0.25 inch. Especially preferred embodiments of the present invention include filaments formed of nylon-6 having an alpha-crystalline content of at least about 45%, more preferably between about 45% to about 55%.

These and other aspects and advantages will become more apparent after careful consideration is given to the following detailed description of the preferred exemplary embodiments thereof.

BRIEF DESCRIPTION OF THE ACCOMPANYING DRAWING

Reference will hereinafter be made to the drawing FIG. 1 which schematically represents a preferred system in accordance with the present invention.

DETAILED DESCRIPTION OF THE INVENTION

Accompanying FIG. 1 schematically represents a particularly preferred system 10 in accordance with the present invention. In this regard, a conventional extruder 12 supplies molten polymeric material via line 12-1 to a spinning head 14. The spinning head 14 includes spinnerettes (not shown) having multiple small orifices through with the molten polymer material is extruded to form streams 14-1, 14-2, 14-3 and 14-4 which are cooled and solidified in the quench chamber 16 to form corresponding multi-filament yarns. The now solidified yarns 14-1 through 14-4 may brought into contact with a finish applicator 18-1, 18-2, 18-3 and 18-4, respectively, whereby a liquid finish is applied onto the surface of the yarns as may be desired.

It should be noted here that four yarns are shown only for the purpose of illustration. Thus, more or less yarns may be spun as desired for the finished yarn product.

The yarns 14-1 through 14-4 are then guided by guides 20-1, 20-2, 20-3 and 20-4 to a pretensioner godet 22. The pretensioner godet 22 serves to prevent slippage of the filaments on the draw rolls and stabilized filament movement. The pretensioned yarns are then drawn in a draw zone 24 between separated pairs of duos 26-1, 26-2 and 28-1, 28-2, respectively. The tensioned yarns (now collectively identified by TY in FIG. 1) may then be separately or collectively subjected to texturing by a conventional texturing unit 30. Most preferably, texturing unit 30 is a fluid jet texturizer wherein a fluid jet at elevated temperature is brought into contact with the drawn yarns to texturize the same. The textured BCF yarns (identified by BCF in FIG. 1) are then wound into a yarn package via winder 32.

In accordance with the present invention, fluid jet texturizer of the texturing unit 30 exhibits relatively low efficiency. That is, the orifice size of the fluid jet texturizer is provided with a relatively larger size fluid jet orifice (i.e., as compared to higher efficiency texturizers) so as to operate at a relatively lower fluid jet velocity. Operating at such a lower fluid jet velocity, however, will not impart the desired cylinder bulk (cc/g) properties. Therefore, in accordance with the present invention, the fluid jet texturizer is operated also at a relatively higher temperature so that comparable cylinder bulk properties (i.e., as compared to higher efficiency texturizers) may be obtained. Therefore, the texturing unit 30 includes, according to the present invention, a fluid jet texturizer operable at sufficiently low fluid jet velocity and at a sufficiently high fluid jet temperature to obtain a yarn skein shrinkage of less than about 0.50 inch (preferably about 0.25 inch or less). When nylon-6 is employed to form the filaments, the fluid jet texturizer will operate at a sufficiently low fluid jet velocity so that the BCF exhibit an alpha-crystalline content of at least about 45% (preferably between about 45% to about 55%).

The filaments may be formed of any synthetic fiber-forming melt-spinnable materials, especially polyesters, polyamides and polyolefins. Suitable polyesters include (but are not limited to) polyethylene terephthalates, polybutylene terephthalates, polytrimethylene terephthalates and copolymers and mixtures thereof. Suitable polyamides include (but are note limited to) nylon 6, nylon 6,6, nylon 6,9, nylon 6,10, nylon 6,12, nylon 11 nylon 12 and copolymers and mixtures thereof. Suitable polyolefins include polypropylene, polypropylene derivatives and copolymers and mixtures thereof.

The present invention will be further understood by reference to the following non-limiting Examples.

EXAMPLES

In the following Examples, the "cylinder bulk", "alpha %" and "skein shrinkage" data were obtained as follows:

Cylinder Bulk: "Cylinder bulk" of a BCF yarn is the specific volume (cc/gm) of a yarn sample under a compression load of about 9 kg. The cylinder bulk is determined by compressing, within a PTFE cylinder using the compression rod of an Instron gage, under a compression load of about 9 kg, a yarn sample weighing 5 grams which has been boiled previously in water for 30 minutes and allowed to dry.

Alpha %: "Alpha %" is the percent of alpha crystallinity in nylon-6 BCF yarn which is determined by infrared spectrometry with a photoacoustic detector and a wire grid polarizer to collect spectral data. The alpha % represents the percent alpha crystallinity of an average of several yarn samples using their respective peak heights at two characterized frequencies for known alpha and gamma crystal absorbances.

Skein Shrinkage: A skein having an original skein length of 54 inches is formed from a fresh twisted, non-heatset yarn package and is hung in a controlled atmosphere of 70° F. and 65% relative humidity. The skein length is measured at predetermined time intervals. On the sixth day, a second skein is made from the same yarn package and the procedures noted above are repeated. The skeins are then subjected to 200° F. saturated steam using a Kusters dye line and the length after such heat-treatment is measured and noted as the skein shrinkage (inches).

Bulked continuous filament (BCF) nylon 6 (ULTRAMID® nylon commercially available from BASF Corporation) carpet yarn samples were run on a one position RieterJO/10 spin-draw-texture machine similar to that depicted schematically in FIG. 1. A control sample was made using standard production conditions for 1100d BCF carpet yarns. The texturing jet used for the control sample was then replaced with a less efficient jet utilizing about an 8% higher cross sectional area. The lower efficiency texturing jet produced less crimp, as evidenced by the position of the yarn plug on the cooling drum. The amount of crimp was then adjusted by increasing the draw duo temperature split so that the position on the cooling drum was identical. For the purposes of these examples, the term "draw duo temperature" is the temperature of the hotter duo roll.

The results of these trials are listed in Table 1 below.

TABLE 1

| | Control Jet | Low Efficiency Jet |
|---|---|---|
| Draw Duo Temperature (° C.) | 178 | 186 |
| Cylinder Bulk (cc/g) | 4.7 | 4.8 |
| Crystallinity in Alpha form (%) | 42 | 45 |
| Skein Shrinkage (inch) | 1.25 | 0.25 |

As the data in Table 1 demonstrate, by using the lower efficiency texturing jet, an 8° C. higher draw duo temperature was required to achieve substantially equivalent crimp as evidenced by the cylinder bulk. For the final yarn, the percentage of crystals in the alpha form increased by 7% while the yarn skein shrinkage upon exposure to air over six days was reduced by 80%.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A nylon-6 yarn comprised of bulked continuous filaments (BCF) exhibiting a yarn skein shrinkage of less than about 0.50 inch, and alpha-crystalline contents in the BCF of at least about 45%.

2. The yarn of claim 1, wherein the alpha-crystalline contents in the BCF are between about 45 to about 55%.

3. The yarn of claim 2, wherein the yarn skein shrinkage is about 0.25 inch or less.

4. The yarn of claim 1, wherein the yarn skein shrinkage is about 0.25 inch or less.

5. A bulked continuous filament (BCE) yarn made by a method which comprises the steps of:

(a) melt-spinning a polymeric material to form multiple filaments thereof followed sequentially by (b) drawing and texturing the filaments to form the yarns of BCF, wherein (c) said step of texturing the filaments includes operating a fluid jet texturizer at a sufficiently low fluid jet velocity and a sufficiently high fluid jet temperature to obtain a yarn skein shrinkage of less than about 0.50 inch.

6. The BCF yarn of claim 5, wherein the polymeric material is nylon-6, and wherein step (c) is practiced to obtain alpha-crystalline contents in the BCF of at least about 45%.

7. The BCF yarn of claim 6, wherein step (c) is practiced to obtain a y skein shrinkage of about 0.25 inch or less.

8. The BCF yarn of claim 7, wherein step (c) is practiced to obtain alpha-crystalline contents in the BCF of between about 45% to about 55%.

9. The BCF yarn of claim 5, wherein step (c) is practiced to obtain a yarn skein shrinkage of about 0.25 inch or less.

10. The BCF yarn of claim 5, wherein the polymeric material is a polyester, polyamide or polyolefin.

11. The BCF yarn of claim 5, wherein the polymeric material is nylon.

12. The BCF yarn of claim 11, wherein the polymeric material is nylon-6.

* * * * *